US006789786B1

(12) United States Patent
Schatzberg

(10) Patent No.: US 6,789,786 B1
(45) Date of Patent: Sep. 14, 2004

(54) TENSIONED FENCE WITH SELF-CLOSING, SELF-LATCHING GATE

(76) Inventor: Michael Schatzberg, 1826 NW. 124th Way, Coral Springs, FL (US) 33071

( * ) Notice: Subject to any disclaimer, the term of this patent is extended or adjusted under 35 U.S.C. 154(b) by 75 days.

(21) Appl. No.: 09/706,557

(22) Filed: Nov. 6, 2000

Related U.S. Application Data

(60) Provisional application No. 60/168,638, filed on Dec. 3, 1999.

(51) Int. Cl.[7] ..... E04H 17/00

(52) U.S. Cl. ..... 256/25; 256/73; 49/381

(58) Field of Search ..... 256/24, 25, 26, 256/45, 73, 67, 32, 47, 1; 49/381, 392

(56) References Cited

U.S. PATENT DOCUMENTS

| | | | | | |
|---|---|---|---|---|---|
| 710,051 | A | * | 9/1902 | Fullam | 16/231 |
| 1,183,562 | A | * | 5/1916 | Howard | 256/41 |
| 1,426,215 | A | * | 8/1922 | Ravert | 256/24 |
| 2,723,107 | A | * | 11/1955 | Parker | 256/24 |
| 2,825,796 | A | * | 3/1958 | Lanmon | 256/1 |
| 3,776,523 | A | * | 12/1973 | Weiland | 256/59 |
| 4,649,597 | A | * | 3/1987 | Cacicedo | 16/253 |
| 5,102,103 | A | * | 4/1992 | Putnam | 256/12 |
| 5,287,167 | A | * | 2/1994 | Shirai et al. | 250/225 |
| 5,494,261 | A | * | 2/1996 | Gandara | 256/24 |
| 5,593,141 | A | * | 1/1997 | Cain et al. | 256/26 |
| 5,664,769 | A | * | 9/1997 | Sadinsky et al. | 256/25 |
| 5,718,414 | A | * | 2/1998 | Deloach et al. | 256/24 |

* cited by examiner

*Primary Examiner*—Lynne H. Browne
*Assistant Examiner*—John Cottingham
(74) *Attorney, Agent, or Firm*—Scott L. Lampert

(57) ABSTRACT

A removable tensioned fence with a self-closing, self-latching gate comprises a plurality of spaced apart poles having a lower end inserted into holes drilled in the deck around the swimming pool and a mesh screening material stretched between such poles. A pair of support structures, each comprising a pair of spaced apart vertical poles, constitutes the outermost poles in the tensioned fence. A lower end of each of the poles is inserted into holes drilled into the deck. A pair of rigid horizontal cross bar extends between the poles in each support structure and mesh screening material is tensioned between the poles. A gate comprised of a pair of spaced apart vertical bars, a pair of spaced apart horizontal bars and mesh screening material tensioned therebetween is supported within a gate opening, defined by the innermost poles of the support structures, by a pair of spaced apart self-closing hinges mounted between one of the innermost poles of a support structure and the adjacent vertical bar of the gate. A self-closing latch is mounted to the other pole and adjacent vertical bar.

9 Claims, 2 Drawing Sheets

TENSIONED FENCE WITH SELF-CLOSING, SELF-LATCHING GATE

This application claims the benefit of U.S. Provisional Application No. 60/168,638 filed Dec. 3, 1999, which has not previously been patented or abandoned.

BACKGROUND OF THE INVENTION

1. Field of the Invention

The present invention relates in general to the field of fences and more, particularly, to a removable tensioned fence capable of supporting a self-closing, self-latching gate.

2. Description of the Related Art

The use of removable tensioned fences has increased greatly over the past several years. Such fences are typically used to enclose a swimming pool or other hazard, and are intended to prevent access to such swimming pools or hazards by small children.

In general, these fences are comprised of a plurality of spaced apart poles, having a lower end inserted into holes drilled at a slight angle to the vertical in the deck around the swimming pool, and a mesh screening material stretched between such poles. The lateral tension applied to the poles by the mesh material force the poles into a generally vertical position in the angled holes, thereby retaining the poles within the holes and providing structural stability to the resultant tensioned fence assembly.

One or more so called "gates" are provided in the fence assembly by placing two of the poles immediately adjacent one another, with no mesh tensioned between such poles. A hook and eye latch is usually included to latch the two poles to one another, thereby providing further structural stability and further means for preventing small children from accessing the swimming pool. To open this "gate" structure, the user must force the two poles together, unlatch the latch, pull one of the poles out of its hole, and swing the removed pole and attached mesh to the side to provide an opening to the swimming pool. To reclose this "gate", the user swings the removed pole and attached mesh back to the hole in the deck from where it was removed, inserts the lower end of the pole into the hole, forces the two adjacent poles together and relatches the latch.

This process has proven to be extremely difficult for many people. Specifically, many people are unable to apply the force necessary to pull the two poles together due to the opposing force being applied to such poles by the tensioned mesh material. Thus, many people are unable to open their "gates" and access their swimming pools and, furthermore, are unable to close such "gates" once opened.

In addition to the above referenced problems inherent in these prior art tensioned fence assemblies, many jurisdictions now require the inclusion of more conventional self-closing, self-latching gate structures with these types of fences. Accordingly, there is a need in the art for an improved, self-closing, self-latching gate structure, which will overcome the problems inherent with the prior arts so-called "gate" structure, that is, one which is capable of proper operation notwithstanding the lateral tension applied by the mesh material to the gate side poles.

However, the mere inclusion of a conventional self-closing, self-latching gate structure in such a tensioned fence assembly has proven to be problematic. Specifically, the lateral forces applied by the tensioned mesh on the gate side poles prevents the gate from swinging properly and, consequently, the self-closing, self-latching feature from functioning properly.

One device developed to address this problem is disclosed in U.S. Pat. No. 5,664,769 to Sadinsky. The Sadinsky structure comprises a gate support structure having a pair of poles inserted into the deck in close proximity to each other, on both sides of the gate, with cross members attached between each pair of poles. The Sadinsky gate support structure is designed so that one of the pair of poles is interconnected to the end pole in the tensioned fence assembly and the second of the pair of poles is interconnected to the gate. Thus, the Sadinsky structure requires that two additional holes be drilled into the deck, in close proximity to each other, on each side of the gate, to support the pair of poles. Accounting for the end poles of the tensioned fence, the Sadinsky design results in three holes drilled in the deck, in close proximity to each other, on each side of the gate, and three poles being inserted, side by side, in such holes (the vertical member of the gate actually adds a fourth adjacent pole). Consequently, the Sadinsky structure requires excessive time and effort to drill holes and results in excessive holes drilled in the decks and an excessive number of poles immediately adjacent one another to properly secure the gate. Additionally, the Sadinsky structure cannot be used with an existing fence unless additional holes are drilled in the deck. Furthermore, the Sadinsky design requires that the holes in the deck be drilled at a small angle opposing the tension force of the mesh screen so that the poles will stand upright within the holes.

Accordingly, there is still a need in the art for a tensioned fence structure capable of supporting a self-closing, self-latching gate, which will withstand the lateral forces applied by the tensioned mesh screening. Any such structure should minimize the number of poles and, consequently, the number of the holes to be drilled into the deck. Additionally, any such structure should be designed so that the holes in the deck do not have to be drilled at angles to oppose the lateral forces applied by the tensioned mesh. Any such structure should also be simple to install and operate and of similar construction to the remainder of the tensioned fence. The present invention is particularly suited to overcome those problems which remain in the art in a manner not previously known.

SUMMARY OF THE INVENTION

The present invention is directed towards a new and improved removable tensioned fence capable of supporting a self-closing, self-latching gate. The tensioned fence is of the type comprising a plurality of spaced apart poles, having a lower end inserted into holes drilled in the deck around the swimming pool, and a mesh screening material stretched between such poles. A pair of support structures, each comprising a pair of spaced apart vertical poles, constitutes the outermost poles in the tensioned fence and is an integral part of the tensioned fence assembly. An opening between the support structures defines a gate opening. A lower end of each of the poles is inserted into holes drilled into the deck, the same as the other poles in the tensioned fence. A rigid horizontal cross bar extends between the poles in each support structure and mesh screening material is tensioned between the poles, the same as it is between the other poles in the tensioned fence. A gate comprised of a pair of spaced apart vertical bars, a pair of spaced apart horizontal bars and mesh screening material tensioned therebetween is supported within a gate opening, defined by the innermost poles of the support structures, by a pair of spaced apart self-closing hinges mounted between one of the innermost poles of a support structure and the adjacent vertical bar of the gate. A self-closing latch is mounted to the other pole and adjacent vertical bar.

It is an object of the present invention to provide a new and improved tensioned fence which has all the advantages of the prior art devices and none of the disadvantages.

It is another object of the present invention to provide a self-closing, self-latching gate assembly for a tensioned fence.

It is also an object of the present invention to provide such an assembly which is capable of withstanding the lateral forces applied by the tensioned mesh screening.

It is a further object of the present invention to provide such an assembly which is similar in structure and appearance to the accompanying tensioned fence.

It is yet another object of the present invention to provide such an assembly which minimizes the number of poles and holes in the deck.

It is also an object of the present invention to provide such an assembly which may be utilized with existing fences without the need to drill additional holes in the deck.

It is yet a further object of the present invention to provide such an assembly which is simple to install and operate.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1:
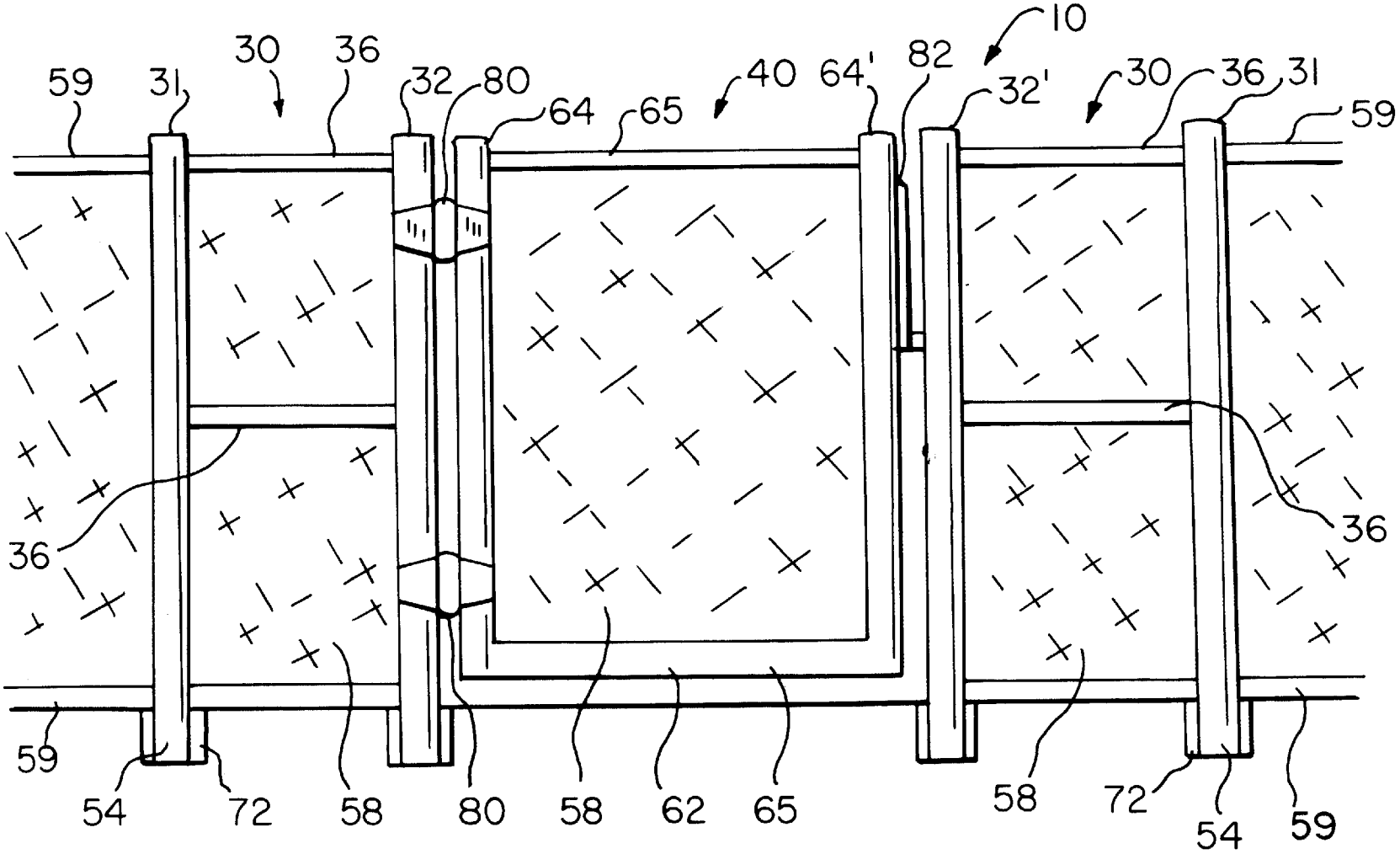
FIG. 1 is a front plan view of the tensioned fence with the self-closing, self-latching gate of the present invention, in partial section.
Figure 2:
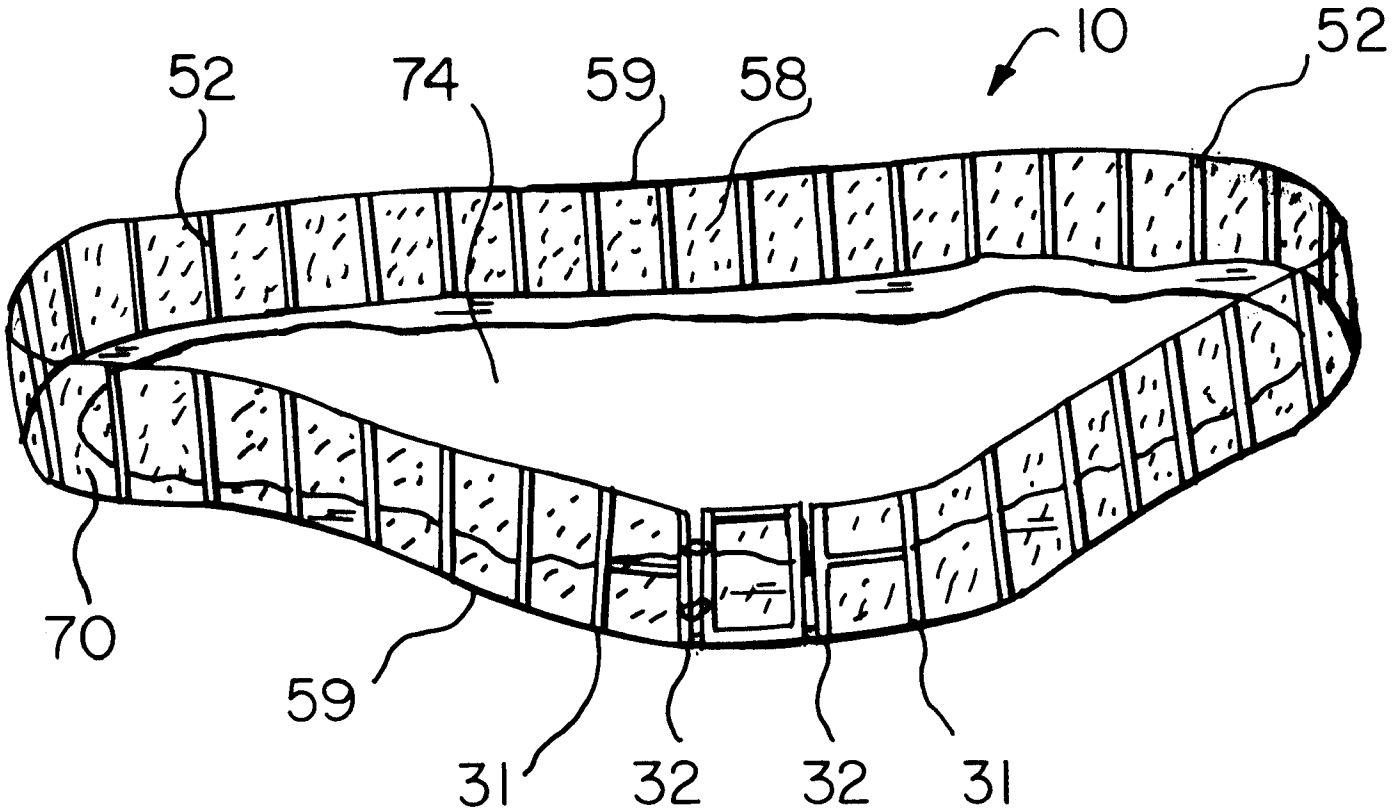
FIG. 2 is a perspective view of the tensioned fence with the self-closing, self-latching gate of the present invention.

As shown in FIGS. 1–2, the present invention is directed towards a new and improved tensioned fence with a self-closing, self-latching gate 10. The fence 10 is of the type comprising a plurality of spaced apart poles 52, having a lower end 54 inserted into holes 72 drilled in the deck 70 around the swimming pool 74, and a mesh screening material 58, with a top and bottom binding 59, stretched between the poles 52. The tension applied to the poles 52 by the mesh material 58 force the poles 52 into a generally vertical position in the holes 72 and provides structural stability to the resultant tensioned fence assembly.

The poles 52 in the present invention are arranged so that an opening 40 is provided for a gate. The pair of spaced apart poles 31, 32 on each side of the opening 40 act as support structures 30. In this manner, the support structures 30 are an integral part of the tensioned fence assembly. A lower end 54 of each of the poles 31, 32 is inserted into holes 72 drilled into the deck 70. Retaining sleeves (not shown) may be inserted into the holes 72 to provide further support and stability to the poles 31, 32. A pair of rigid horizontal cross bars 36 extend between the poles 31, 32 in each support structure 30. In the preferred embodiment, one of the cross bars 36 is disposed at a height generally half way up the vertically extending poles 31, 32 and the second is disposed at the top of the vertically extending poles 31, 32. Mesh screening material 58 is tensioned between the spaced apart poles 31, 32 in each of the support structures 30, as it is between the other poles 52 in the tensioned fence assembly, resulting in the overall tensioned fence assembly, with the support structures 30, being uniform in appearance. This differs from the truss structures used as prior art tensioned fence assemby support structures, which clearly appear as a separate structure next to the tensioned fence assembly. It should be appreciated that the cross bars 36 may, alternatively, be disposed at the bottom and top of the mesh screening 58, aligned with the top and bottom bindings 59 on the mesh screening material 58 on the adjacent poles 52, further providing a uniform appearance.

Additionally, because the support structures 30 are an integral part of the tensioned fence assembly, they not only provide structural stability to the gate 62, but they also provide structural stability to the entire tensioned fence assembly. Thus, it is not necessary to drill the holes 72 in the deck 70 at an angle opposing the lateral force applied to the poles 52 by the tensioned mesh material 58 of the tensioned fence assembly, as it is with prior art structures, to withstand such forces and provide structural stability to the tensioned fence assembly.

The innermost poles 32, 32' of the support structures 30 define the gate opening 40. A gate 62 comprised of a pair of spaced apart vertical bars 64, 64', a pair of spaced apart horizontal bars 65 and mesh screening material 58 tensioned therebetween is supported within the gate opening 40 by a pair of spaced apart self-closing hinges 80 mounted between one of the innermost poles 32 of a support structure 30 and the adjacent vertical bar 64 of the gate 62. A self-closing latch 82 is mounted to the other innermost pole 32' and adjacent vertical bar 64'. In the preferred embodiment, the latch 82 is magnetic. The resultant self-closing, self-latching gate 62 is structured to automatically close and latch after being opened to prevent access to the swimming pool 74 by small children. The configuration of the support structures 30 enable the gate 62 to freely open and close without being effected by any lateral forces from the accompanying tensioned fence. Moreover, only the poles 52 of the tensioned fence assembly require holes in the deck. No additional holes 72 need be drilled into the deck 70 to support the gate 62, as is necessary with prior art systems using truss-type support structures.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A removable tensioned fence and gate assembly comprising:

a tensioned fence portion having:

a plurality of spaced-apart, generally vertically disposed rigid support members terminating at a first end in a first end support member and at a second opposite end in a second end support member, said first and second end support members defining a gate opening, each of said support members and said firsthand second end support members having a lower end removably secured to the ground;

a generally mesh screen enclosure attached to and tensioned between each pair of adjacent support members of said tensioned fence portion, said screen enclosure having an upper edge and an opposite lower edge;

a first generally horizontally disposed rigid bar extending between said first end support member and said support member of said tensioned fence portion adjacent said first end support member generally midway between said upper edge and said lower edge, said first generally horizontally disposed rigid bar structured to support said first end support member in substantially vertical alignment; and a second generally horizontally disposed rigid bar extending between said second end support member and said support member of said tensioned fence portion adjacent said second end support member generally midway between said upper edge and said lower edge, said second generally horizontally disposed rigid bar structured to support said second end support member in substantially vertical alignment; and a gate having first and second spaced-apart, vertically disposed poles, at least one generally horizontally disposed cross bar extending between said first and second poles and a generally mesh tensioned screen panel attached to and tensioned between said first and second poles, said first pole being hingedly attached to and supported by said first end support member and said second pole having a latching member structured for mating engagement with a corresponding latching member on said second end support member so that said gate may swing from a first closed position, wherein said gate encloses said late opening and said latching member of said second pole is in mating engagement with said corresponding latching member of said second end support member, to a second open position, wherein said gate is substantially removed from said gate opening.

2. A tensioned fence and gate assembly as recited in claim 1 wherein said gate includes two cross bars.

3. A tensioned fence and gate assembly as recited in claim 1 wherein said latch is self-latching.

4. A tensioned fence and gate assembly as recited in claim 3 wherein said latch is magnetic.

5. A removable tensioned fence and gate assembly having a plurality of spaced-apart, generally vertically disposed rigid support members terminating at opposite ends in first and second end support members defining a gate opening, and a generally mesh-like screen enclosure, having an upper edge and an opposite lower edge attached to and tensioned between each pair of adjacent support members, the assembly comprising:

a first generally horizontally disposed rigid bar extending between the first end support member and the support member adjacent the first end support member generally midway between the upper edge and the lower edge and a second generally horizontally disposed rigid bar extending between the second end support member and the support member adjacent the second end support member generally midway between the upper edge and the lower edge, said generally horizontally disposed rigid bar structured to support the first and second end support members in substantially vertical alignment; and a gate having first and second spaced-apart vertically disposed poles at least one generally horizontally disposed cross bar extending between said first and second poles and a generally mesh tensioned screen panel attached to and tensioned between said first and second poles, said first pole being hingedly attached to and supported by the first end support member and said second pole having a latching member structured for mating engagement with a corresponding latching member on the second end support member so that said gate may swing from a first closed position, wherein said gate encloses the gate opening and said latching member of said second pole is in mating engagement with said corresponding latching member of the second end support member, to a second open position wherein said gate is substantially removed from the gate opening.

6. A tensioned fence and gate assembly as recited in claim 5 wherein said gate includes two cross bars.

7. A tensioned fence and gate assembly as recited in claim 5 wherein said latch is self-latching.

8. A tensioned fence and gate assembly as recited in claim 7 wherein said latch is magnetic.

9. A removable tensioned fence and gate assembly comprising:

a tensioned fence portion having:

a plurality of spaced-apart, generally vertically disposed poles terminating at a first end in a first end pole and at a second opposite end in a second end pole, said first and second end poles defining a gate opening, said poles and said first and second end poles having a lower end removably seated within corresponding spaced-apart holes in the ground so that said poles and said first and second end poles may be readily removed from said holes;

a generally mesh screen enclosure attached to and tensioned between each pair of adjacent poles of said tensioned fence portion, said screen enclosure having an upper edge and an opposite lower edge;

a first generally horizontally disposed rigid bar extending between said first pole and said pole of said tensioned fence portion adjacent said first pole generally midway between said upper edge and said lower edge, said first generally horizontally disposed rigid bar structured to support said first pole in substantially vertical alignment; and a second generally horizontally disposed rigid bar extending between said second pole and said pole of said tensioned fence portion adjacent said second pole generally midway between said upper edge and said lower edge, said second generally horizontally disposed rigid bar structured to support said second pole in substantially vertical alignment; and a gate having first and second spaced-apart, vertical poles, at least one generally horizontal cross bar extending between said first and second vertical poles and a generally mesh tensioned screen panel attached to and tensioned between said first and second vertical poles, said first vertical pole being hingedly attached to and supported by said first end pole of said tensioned fence portion and said second vertical pole having a latching member structured for mating engagement with a corresponding latching member on said second pole of said tensioned fence portion so that said gate may swing from a first closed position, wherein said gate encloses said gate opening and said latching member of said second vertical pole is in mating engagement with said corresponding latching member of said second end pole of said tensioned fence portion, to a second open position, wherein said gate is substantially removed from said gate opening.

* * * * *